US005769679A

United States Patent [19]

Park et al.

[11] Patent Number: 5,769,679

[45] Date of Patent: Jun. 23, 1998

[54] METHOD FOR MANUFACTURING FIELD EMISSION DISPLAY DEVICE

[75] Inventors: Jong-Moon Park; Yeong-Cheol Hyeon; Kee-Soo Nam, all of Daejeon, Rep. of Korea

[73] Assignee: Electronics and Telecommunications Research Institute, Daejeon, Rep. of Korea

[21] Appl. No.: 710,528

[22] Filed: Sep. 18, 1996

[30] Foreign Application Priority Data

Dec. 22, 1995 [KR] Rep. of Korea ..... 95-54549

[51] Int. Cl.[6] ..... H01J 1/30; H01J 9/18

[52] U.S. Cl. ..... 445/50; 445/24; 313/309

[58] Field of Search ..... 445/24, 50, 51; 313/309

[56] References Cited

U.S. PATENT DOCUMENTS 5,302,238 4/1994 Roe et al. ..... 445/50

5,382,185 1/1995 Gray et al. ..... 313/309

5,457,355 10/1995 Fleming et al. ..... 313/309

5,584,740 12/1996 Hsu et al. ..... 445/50

*Primary Examiner*—P. Austin Bradley

*Assistant Examiner*—Jeffrey T. Knapp

*Attorney, Agent, or Firm*—Antonelli, Terry, Stout & Kraus, LLP

[57] ABSTRACT

In a method, a film for a gate electrode, exposed through the sidewall of a trench, is thermally treated to grow a thermal oxide film which is, then, removed at the lateral side of the gate electrode, to spatially separate the gate electrode from the gate insulating film in space. This method precisely controls the thermal oxide film formed at the lateral side of the gate electrode, so that the distance between the gate electrode and the electron emission cathode can be accurately adjusted. The electron emission cathodes are homogeneous in shape. Also, the reliability of the display can be improved since a silicide metal is formed on the electron emission cathodes.

6 Claims, 6 Drawing Sheets

METHOD FOR MANUFACTURING FIELD EMISSION DISPLAY DEVICE

BACKGROUND OF THE INVENTION

1. Field of the Invention

The present invention relates to a novel method for manufacturing a field emission display device and more particularly, to a novel method for manufacturing a field emission display device having sidewall electron emission cathodes.

2. Description of the Prior Art

Similar to a cathode ray tube in the principle of emitting light from fluorescents, a field emission display device is being watched with keen interest as a flat display device which satisfies the lightness, thinness, shortness and smallness of a liquid crystal display and the high picture quality of a cathode ray tube at the same 00time. That is, the electron emission cathode of a field emission display is responsible for the role corresponding to the electron gun of a cathode ray tube. Generally, the electron emission cathode, which emits electrons through the application of high electric a field, has a sharp tip into which a high current density is focused in order to into which a high current density is focused in order to enhance the emission of electrons. The sharper the tip is, the lower the voltage at which the field emission display can be operated.

In manufacturing a field emission display device, there have been suggested various important variables to lower operating voltage, including the proximity between electron emission cathode and fluorescent, the narrow space between electron emission cathode and gate electrode, the sharpness of the tip of electron emission cathode, and the 0enlargement of electron emission area. Of them the sharpness of the tip of electron emission cathode and the enlargement of electron emission area are recognized as the most effective. Typically, the enlargement of electron emission area can be accomplished by forming the tip of electron emission cathode into the shape of a crater.

In order to better understand the background of the present invention, a description will be given of a field emission display structure and a conventional method for enlarging the area of electron emission cathode in a field emission display device, in connection with some drawings.

Referring to FIG. 3, there is shown a structure of a field emission display apparatus. On the lower substrate of the field emission display apparatus, a plurality of 0spaced electron emission cathode lines (not shown) are formed in such a way that they may proceed in one direction. As seen in FIG. 3, a plurality of electron emission cathode groups 215, each including a plurality of electron emission cathodes 508, are formed on the predetermined areas of the electron emission cathode lines, each of which corresponds to one pixel of upper plate fluorescent. Gate electrodes 503 which accelerate the electrons emitted from the electron emission cathodes 508, are formed on an insulating film (not shown) which is deposited over all the surfaces except for the electron emission cathodes 508.

Referring to FIG. 1, there is illustrated a conventional method for enlarging the area of the electron emission cathodes in such a field emission display device structure.

First, as shown in FIG. 1A, a first insulating film 502*a* is formed on a substrate 501, in order to electrically 0disconnect a gate electrode from the substrate 501, after which a first conductive film 503*a* as a metal for gate electrodes and a second insulating film 504*a* are in sequence formed over the first insulating film 502*a*.

Then, as shown in FIG. 1B, a predetermined area of the first insulating film 502*a*, the first conductive film 503*a* and the second insulating film 504*a* is subjected to photolithography using an etch mask, to form a cylindrical trench 505. At this time, the first conductive film 503*a* and the first insulating film 502*a* are patterned to form a gate electrode 503 and a gate insulating film 502, respectively. As a result, an electron emission cathode region is defined. Thereafter, a blanket of an insulating film is formed as a sacrificial film to separate the gate 0electrode 503 from the electron emission cathode and then, anisotropically dry etched to form an insulating film 506 at the sidewall of the trench 505.

FIG. 1C is a cross section after a metal for forming an electron emission cathode is deposited over the exposed areas, to form a second conductive film 508*a*.

FIG. 1D is a cross section after the second conductive film 508*a* is anisotropically dry etched in such a way that it may remain only within the trench 505, to form an electron emission cathode 508.

Considering from a structural standpoint, it is however difficult to electrically isolate the electron emission cathode lines formed within the substrate 501 from each other by directly forming electron emission cathodes (not shown) on the substrate 501 of such conventional field emission display devices, for example, without forming the electron emission cathode lines with a conductive metal. That is, the structure of the conventional field emission display device does not allow separation of the electron emission cathode line electrically from the surface of the substrate 501 merely by forming cathode electrode lines, for example, by implanting impurities in the substrate 501 without formation of the electron emission cathode lines on the substrate 501.

In order to make the tip of the electron emission cathode 508 vertically sharp, it is required that the second conductive film 508*a* be dry etched down to the lower part of the round portion 507 of the insulating film 506 formed at the sidewall of the trench 505. This can be achieved by overetching the second conductive film 508*a*. At this moment, the bottom surface of the trench may also be etched to form a recession 506 over the bottom of the trench 505, disconnecting the electron emission cathode 505 from the electron emission cathode line formed in the substrate 501. Thus, such overetching for sharpening the tip of the electron emission cathode 508 may lead to a process failure. On the other hand, if one does not sufficiently etch the second conductive film 508*a*, for fear of overetching the bottom of the substrate 501 within the trench 505, the tip of the electron emission cathode 508 may be etched only until it is rounded 507. In this case, the tip of the electron emission cathode gets bent externally, remaining dull.

SUMMARY OF THE INVENTION

It is therefore an objective of the present invention to provide a method for manufacturing a field emission display device, whereby one electron emission cathode formed on a substrate can be readily separated from another formed on a different line.

It is another objective of the present invention to provide a method for manufacturing a field emission display device, which allows the distance between gate electrode and electron emission cathode to be readily controlled.

It is a further objective of the present invention to provide a method for manufacturing a field emission display device, whereby the problem of the disconnection between electron emission cathode and conductive layer of electron emission cathode can be overcome.

Based on the intensive and thorough research by the present inventors, the above objectives could be accomplished by providing a method for manufacturing a field emission display device, comprising the steps of: sequentially forming a first insulating film and a first conductive film on a substrate and patterning the first insulating film to form a plurality of electron emission cathode lines, each having a predetermined width; depositing a second insulating film, a second conductive film and a third insulating film over the whole surface of the substrate, in due order; selectively etching the third insulating film, the second conductive film and the second insulating film, to form a gate electrode and a trench through which a predetermined area of the electron emission cathode line is exposed; forming a fifth insulating film at the lateral side of the gate electrode; forming a blanket of a third conductive film over the resulting structure and selectively etching the third conductive film, to form an electron emission cathode at the sidewall of the trench; and removing the second insulating film pattern and the fifth insulating film pattern and partially etching the side of the gate insulating film, simultaneously, to separate the gate electrode from the electron emission cathode in space.

BRIEF DESCRIPTION OF THE DRAWINGS

The above and other objects and aspects of the invention will become apparent from the following description of embodiments with reference to the accompanying drawings in which.

DETAILED DESCRIPTION OF THE PREFERRED EMBODIMENT

Figure 1A:
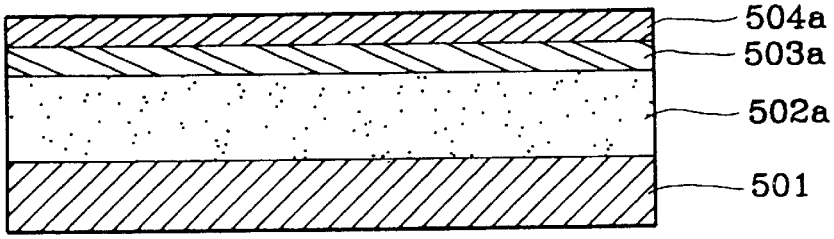
FIG. 1A PRIOR ART
FIGS. 1A through 1D are schematic cross sectional views showing a conventional method for a field emission display device having a sidewall electron emission cathode.
Figure 1B:
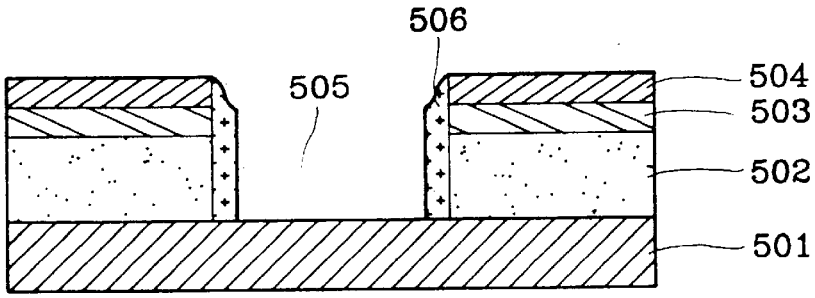
FIG. 1B PRIOR ART
Figure 1C:
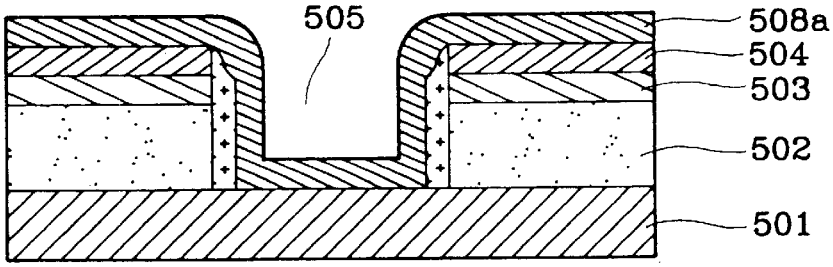
FIG. 1C PRIOR ART
Figure 1D:
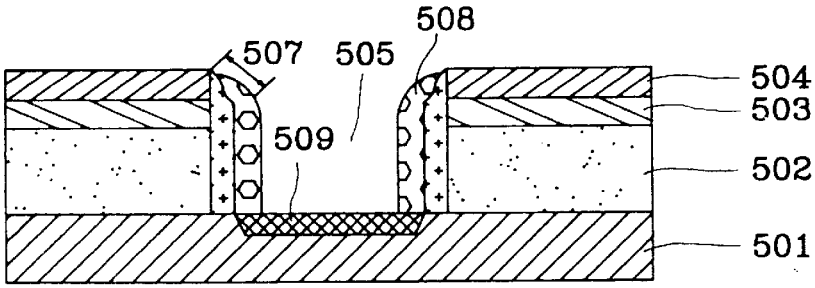
FIG. 1D PRIOR ART

The application of the preferred embodiment of the present invention is best understood with reference to the accompanying drawings, wherein like reference numerals are used for like and corresponding parts, respectively.

Referring to FIGS. 2A through 2I, there is stepwise illustrated a method for manufacturing a field emission display device, in accordance with the present invention.

Figure 2A:
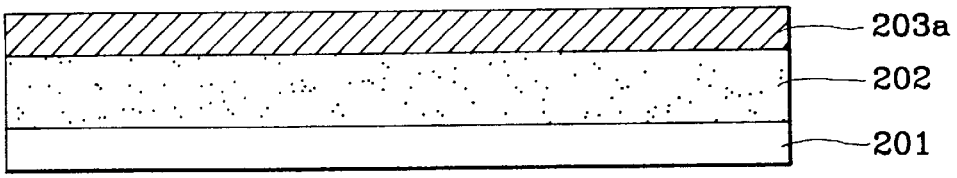
FIGS. 2A through 2K are schematic cross sectional views showing a novel method for a field emission display device having a side electron emission cathode, according to the present invention.

First, as shown in FIG. 2A, a first insulating film 202 is formed on a silicon wafer 201, followed by the deposition of a first conductive film 203*a* over the first insulating film 202. For the first conductive film 203*a*, impurity-doped polysilicon is used and will serve as a conducting layer for electron emission cathode line. The first insulating film 202*a* electrically disconnects a gate electrode which is formed later, with lower electron emission cathode lines connecting the substrate 201 with electron emission cathodes which are formed later.

Alternatively, a glass substrate may be employed instead of the silicon wafer 201. In this case, the first insulating film 202 needs not be formed.

Figure 2B:
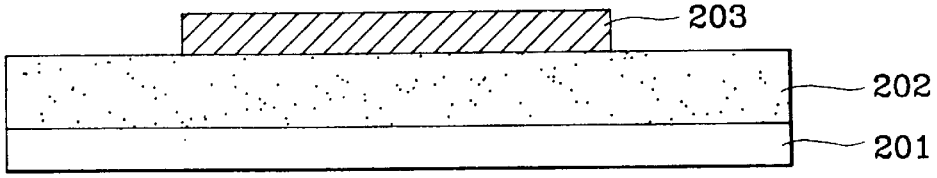

Then, using a photolithographic technique, the first conductive film 203*a* on the first insulating film 202 is patterned into a plurality of electron emission cathode lines 203, each having a predetermined width, as shown in FIG. 2B.

Serving as the wiring lines which provide electric currents to the electron emission cathodes, the electron emission cathode lines 203 provide sites on which the electron emission cathodes will be formed in the lower plate of the field emission display device.

Figure 2C:
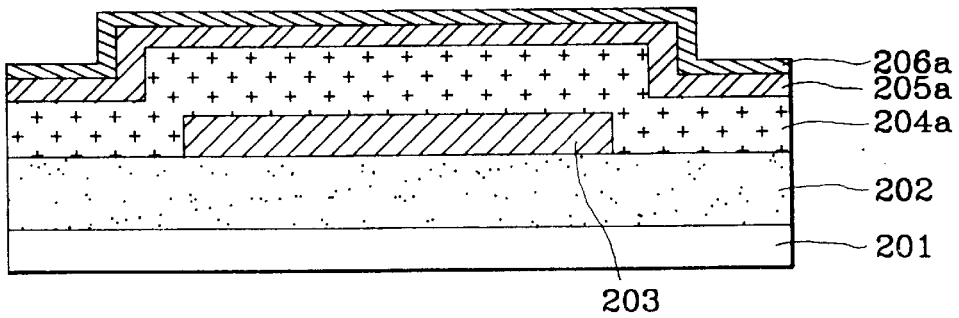

On the whole surface of the resulting structure is formed a CVD oxide film about 1 um thick, to form a second insulating film 204*a* for a gate, as seen in FIG. 2C. Thereafter, impurity-doped polysilicon is deposited over the second insulating film 204*a*, to form a second conductive film 205*a* for a gate electrode, followed by the formation of a third insulating film 206*a* with a CVD oxide over the second conductive film 205*a*. The third insulating film 206*a* is a kind of a sacrificial film to prevent the deterioration of gate properties attributable to the surface damage which may occur in a etching process for an forming an trench for electron emission cathode.

Figure 2D:
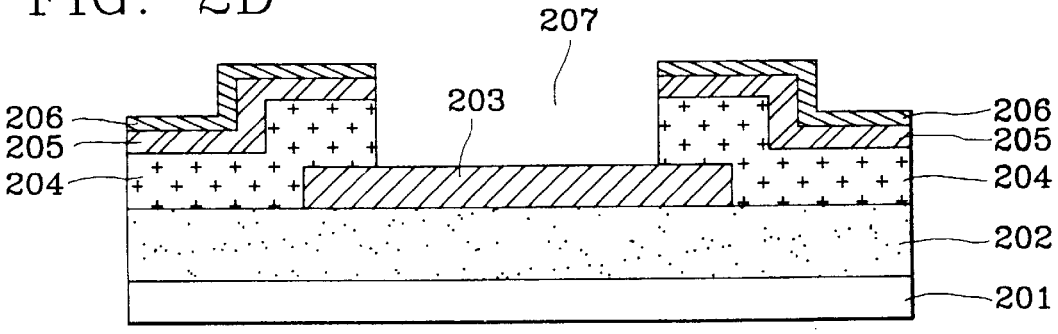
Figure 2E:
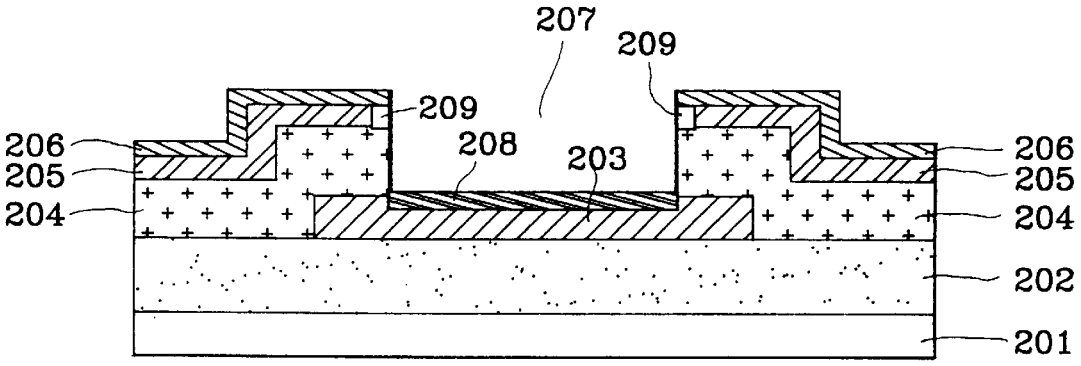

FIG. 2D is a cross section after a predetermined area of the third insulating film 206*a*, the second conductive film 205*a* and the second insulating film 204*a* is opened by anisotropic dry etch, to selectively expose a surface of the electron emission cathode line 203*a* to define a formation area of an electron emission cathode. As a result, a trench with a predetermined diameter is formed, simultaneously with the formation of a third insulating film pattern 206, a gate electrode 205 and a gate insulating film 204. FIG. 2E is a cross section after the exposed surface of the electron emission cathode line 203 within the trench 207 and the lateral surface of the gate electrode 205 are thermally oxidized to grow a fourth oxide insulating film 208 and a fifth oxide insulting film to a predetermined thickness, respectively. Since the electron emission cathode line 203 and the second conductive film 205 both are formed of impurity-doped polysilicon, such thermal oxide films can be formed by heat.

Figure 2F:
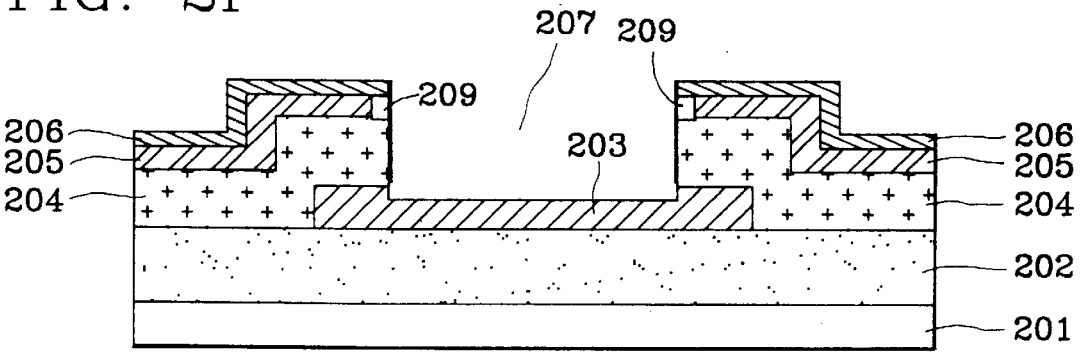

Subsequently, the fourth insulating film 208 formed on the surface of the electron emission cathode line 203, is removed, to allow for contact with a film for an electron emission cathode which is formed later, as seen in FIG. 2F. For the removal of the fourth insulating film, an anisotropic dry etch is applied, so as not to etch the fifth insulating film 209 formed at the side of the gate electrode 205.

Figure 2G:
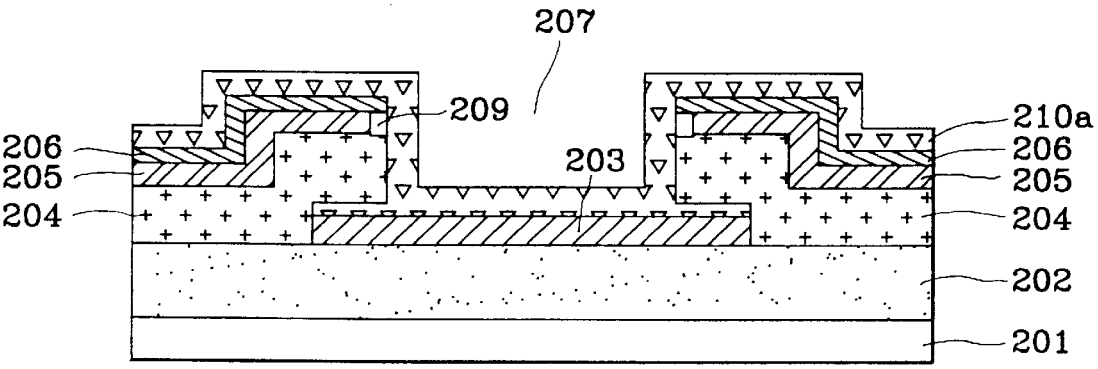

Then, impurity-doped polysilicon is entirely deposited over the resulting structure, as seen in FIG. 2G. Since the thickness of the electron emission cathode is determined dependently on the thickness of the deposited polysilicon, it is required to have an appropriate thickness and to be ion implanted with high density impurities.

Figure 2H:
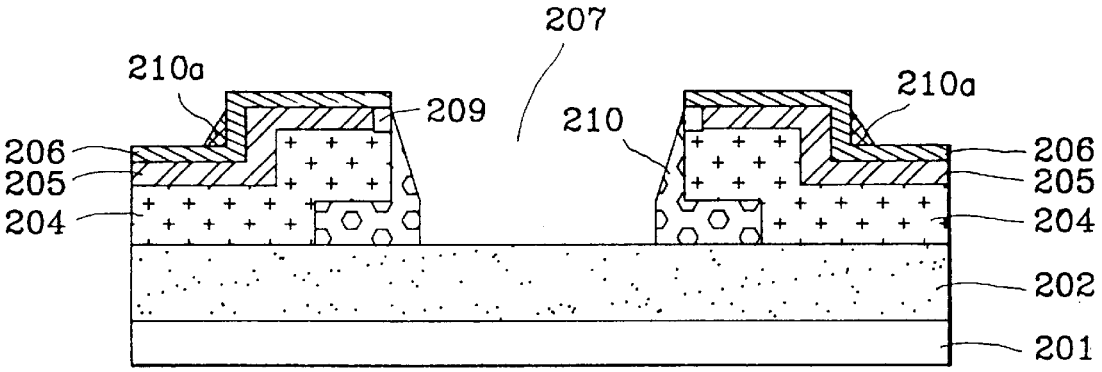

Succeedingly, the film 210*a* for an electron emission cathode is anisotropically dry etched in a vertical direction, to define an electron emission cathode 210 at the sidewall of the trench 207, as seen in FIG. 2H.

Figure 2I:
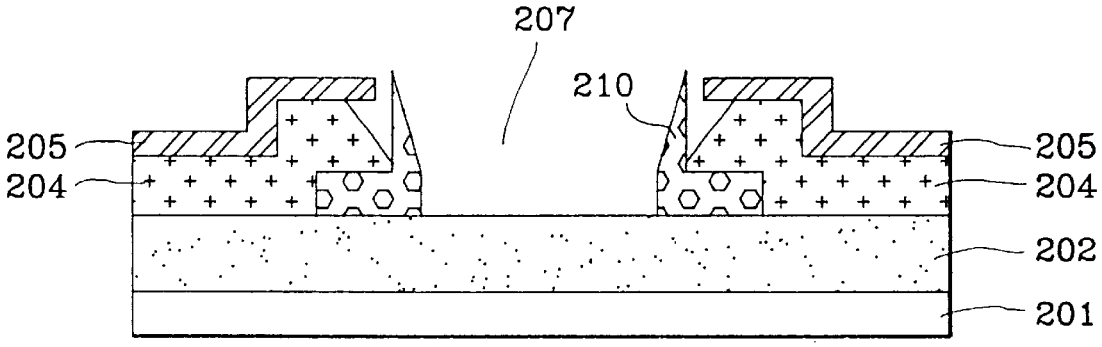

Then, as shown in FIG. 2I, a wet etch using a hydrofluoric acid solution (10:1) is applied, to remove the residual third insulating film 206 from the surface and lateral side of the gate electrode 205 and the residual conductive pattern 210*a* from the step of the fifth insulating film 209 and the third insulating film 206 as well as to etch a certain portion of the gate insulating film 204 near to the trench 207, separating the gate electrode 205 from the electron emission cathode 210 in space.

All of the third insulating film 206, the fifth insulating film 209 and the gate insulating film 204 can be removed by a wet etch process because they are formed of oxide.

Figure 2J:
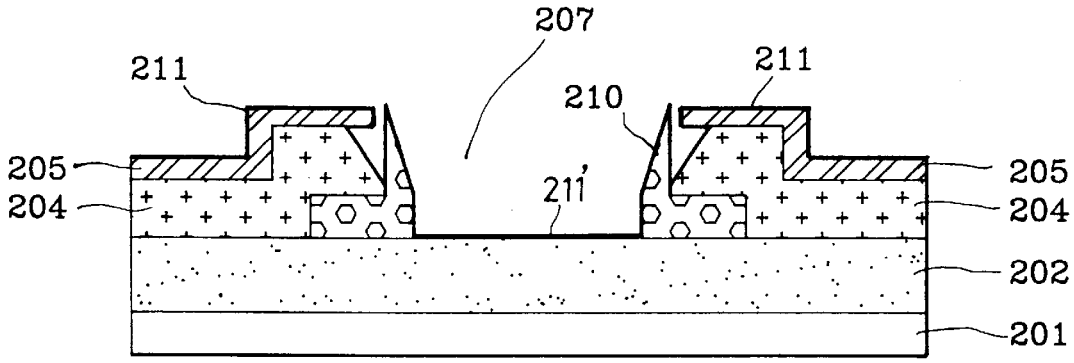
Figure 2K:
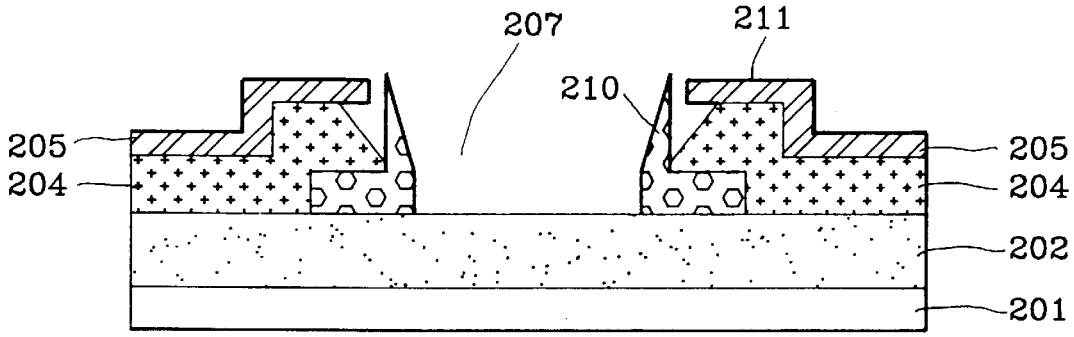
Figure 3:
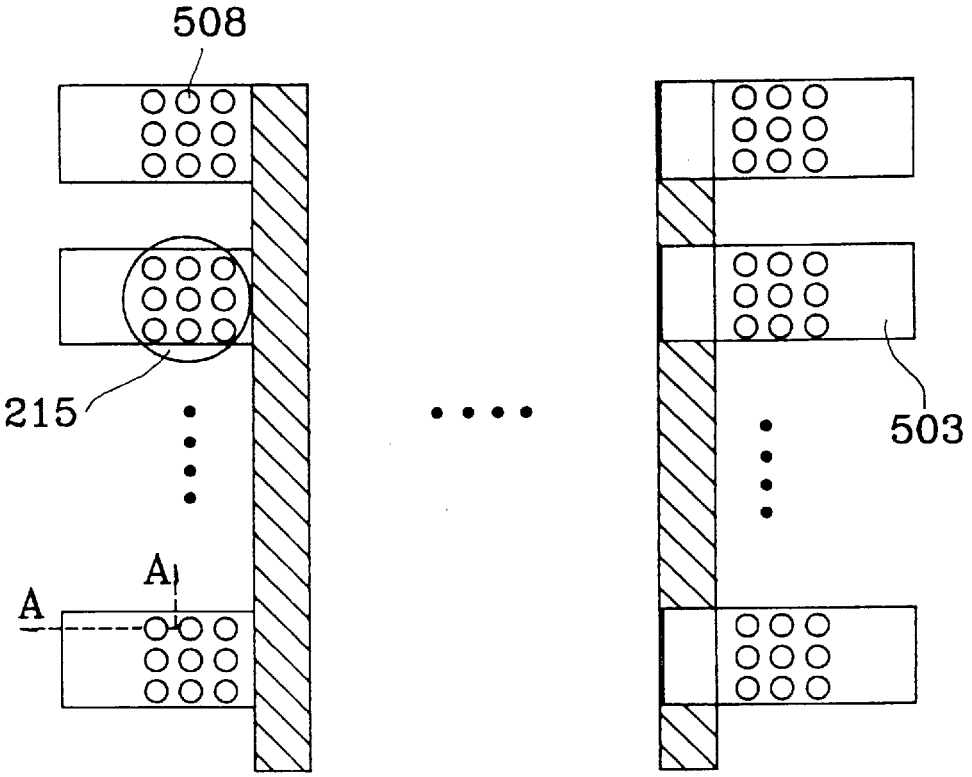
FIG. 3 is a schematic plane view showing a lower plate of a field emission display device having electron emission cathodes and gate electrodes.

Finally, as shown in FIG. 2J and 2K, a silicide process is carrying out to enhance a reliability of the cathode tip device. More specifically, a barrier metal, for example Pt, is entirely deposited over the resulting structure and annealed.

At this time, an ultra-thin silicide metal 211 is formed on the electron emission cathode 210 and the gate electrode 205 composed of polysilicon. On the other hand, non-silicide Pt metal 211' is formed on the first insulating film 202 and the gate insulating film 204, as shown in FIG. 2J. Thereafter, the Pt metal 211' is removed by wet etching used in aqua regia.

As described hereinbefore, it is apparent that the disconnection between the electron emission cathode line and the electron emission cathode, resulting from the overetching of the film for electron emission cathode, can be prevented according to the present invention. Also, the reliability of the field emission display can be significantly improved by silicide processing for the electron emission cathode tip.

Therefore, an electron emission cathode which us uniform in shape and wide in electron emission area and which contributes to high quality picture of a field emission display device, can be fabricated by the method of the present invention. In addition, the electron emission cathodes aligned on the electron emission cathode array can be effectively separated by forming them on spaced electron emission cathode lines respectively, resulting in a significant improvement in the reliability of the field emission display device.

The present invention has been described in an illustrative manner, and it is to be understood the terminology used is intended to be in the nature of description rather than of limitation.

Many modifications and variations of the present invention are possible in light of the above teachings. Therefore, it is to be understood that within the scope of the appended claims, the invention may be practiced otherwise than as specifically described.

What is claimed is:

1. A method for manufacturing a field emission display device, comprising the steps of:

sequentially forming a first insulating film and a first conductive film on a substrate and patterning the first conductive film to form a plurality of electron emission cathode lines, each having a predetermined width;

depositing a second insulating film, a second conductive film and a third insulating film over the whole surface of the substrate, in due order;

selectively etching the third insulating film, the second conductive film and the second insulating film, to form a gate electrode and a trench through which a predetermined area of the electron emission cathode line is exposed;

forming a fifth insulating film at the lateral side of the gate electrode;

forming a blanket of a third conductive film over the resulting structure and selectively etching the third conductive film, to form an electron emission cathode at the sidewall of the trench; and removing the second insulating film pattern and the fifth insulating film pattern and partially etching the side of the gate insulating film, simultaneously, to spatially separate the gate electrode from the electron emission cathode.

2. A method in accordance with claim 1, wherein said first conductive film, said second conductive film and said third conductive film each are formed of polysilicon.

3. A method in accordance with claim 1, wherein said trench is formed by anisotropic dry etch.

4. A method in accordance with claim 1, wherein said third insulating film serves as a sacrificial film to prevent the surface damage of said second conductive film which occurs in an anisotropic dry etch for trench formation.

5. A method in accordance with claim 1, wherein said fifth insulating film is formed by thermal oxidation.

6. A method in accordance with claim 1, further comprising the steps depositing a silicide metal on the electron emission cathode annealing said siicide metal to enhance the reliability of the electron emission cathode.

* * * * *